US005487574A

United States Patent [19]

Salling

[11] Patent Number: 5,487,574

[45] Date of Patent: Jan. 30, 1996

[54] DOOR OPERATING MECHANISM

[75] Inventor: Bo Salling, Skensved, Denmark

[73] Assignee: Scanbur A/S, Køge, Denmark

[21] Appl. No.: 463,068

[22] Filed: Jun. 5, 1995

Related U.S. Application Data

[63] Continuation-in-part of Ser. No. 295,608, Aug. 25, 1994, abandoned.

[30] Foreign Application Priority Data

Aug. 25, 1993 [DK] Denmark ..... 0959/93

[51] Int. Cl.[6] ..... E05C 9/08

[52] U.S. Cl. ..... 292/218; 292/54

[58] Field of Search ..... 312/401, 405, 312/215; 49/394, 395; 292/257, 202, 203, 54, DIG. 70, DIG. 20, DIG. 21, DIG. 33, DIG. 51, DIG. 4, 216, 218

[56] References Cited

U.S. PATENT DOCUMENTS

| | | | |
|---|---|---|---|
| 1,925,234 | 9/1933 | Dath | 268/72 |
| 1,952,112 | 3/1934 | Bartsch | 292/218 |
| 1,956,679 | 5/1934 | Haseltine | 268/72 |
| 2,297,007 | 9/1942 | Lounsbury | 292/241 |
| 4,082,330 | 4/1978 | McWhorter | 292/218 |
| 4,753,466 | 6/1988 | Umebachi et al. | 292/218 |

*Primary Examiner*—Steven N. Meyers
*Assistant Examiner*—Tuyet-Phuong Pham
*Attorney, Agent, or Firm*—Gordon W. Hueschen

[57] ABSTRACT

A door operating mechanism, preferably a door operating mechanism for cabinets, comprising a vertical pivot shaft (2) equipped with eccentric pins (5) at opposite ends thereof to cooperate with keeper members (3) characterized by, that the vertical pivot shaft (2) is pivotally retained clamps (4) secured to the door at certain distances from the bottom and the top of the cabinet doors and from the ends of the pivot shaft (2), thereby permitting the elastic or resilient force occuring in the vertical pivot shaft (2) when the ends thereof are distended laterally by engagement of the eccentric or offset pins (5) with the detents (9) of the keeper members (3), to be employed to close the door tightly against the sealing gasket (21) on the cabinet.

4 Claims, 4 Drawing Sheets

DOOR OPERATING MECHANISM

The present application is a continuation-in-part of my prior-filled application Ser. No. 08/295,608, filed Aug. 25, 1994, now abandoned.

The present invention relates to improvements in door operating mechanisms, and especially door operating mechanisms for cabinets, comprising a vertical elastic pivot shaft equipped with eccentric pins at opposite ends thereof to cooperate with keeper members. A number of clamps which are secured to the door at a certain distance from the top and the bottom and in spaced-apart relationship from the ends of the vertical pivot shaft accommodate the vertical shaft in pivotal relational. The fixing of the shaft by means of a number of clamps provides the vertical shaft with an elastic effect thereby ensuring optimal tightening of the door against the sealing gasket of the cabinet.

BACKGROUND OF THE INVENTION

Today it is known to use door operating mechanisms, especially for double hinged doors for refrigerator cars, where the operating mechanism comprises one vertical shaft with pins cooperating with keeper members at the top and at the bottom. The handle is horizontally secured to one door.

In principle said door operating mechanism comprises two eccentric pins which cooperate with keeper members at the top and at the bottom. Said door operating mechanism is manufactured from up to approximately 30 individual components.

See for example according to U.S. Pat. No. 1,925,234, U.S. Pat. No. 1,952,112, U.S. Pat. No. 1,956,679, and U.S. Pat. No. 2,297,007.

None of the above mentioned door operating mechanisms are actuated by the elastic force occuring in the vertical shaft when secured to a number of clamps on the door.

OBJECT OF THE INVENTION

It is an object of the present invention to provide a door operating mechanism which assures optimal tightening of cabinet doors, e.g. doors for laboratory cabinets, experimental animal cabinets, refrigerator cars, refrigerators, deep freezers, containers, industrial washing machines, and industrial automatic dishwashers.

Another object of the present invention is to provide a door operating mechanism consisting of as few individual parts as possible, and thereby reducing manufacturing costs for materials, molding tools, mounting, etc. to a minimum.

A further object of the present invention is to provide a door operating mechanism which can be easily cleaned by comprising only simple components in a limited number.

DESCRIPTION OF THE INVENTION

DETAILED DESCRIPTION OF THE INVENTION

Figure 1:
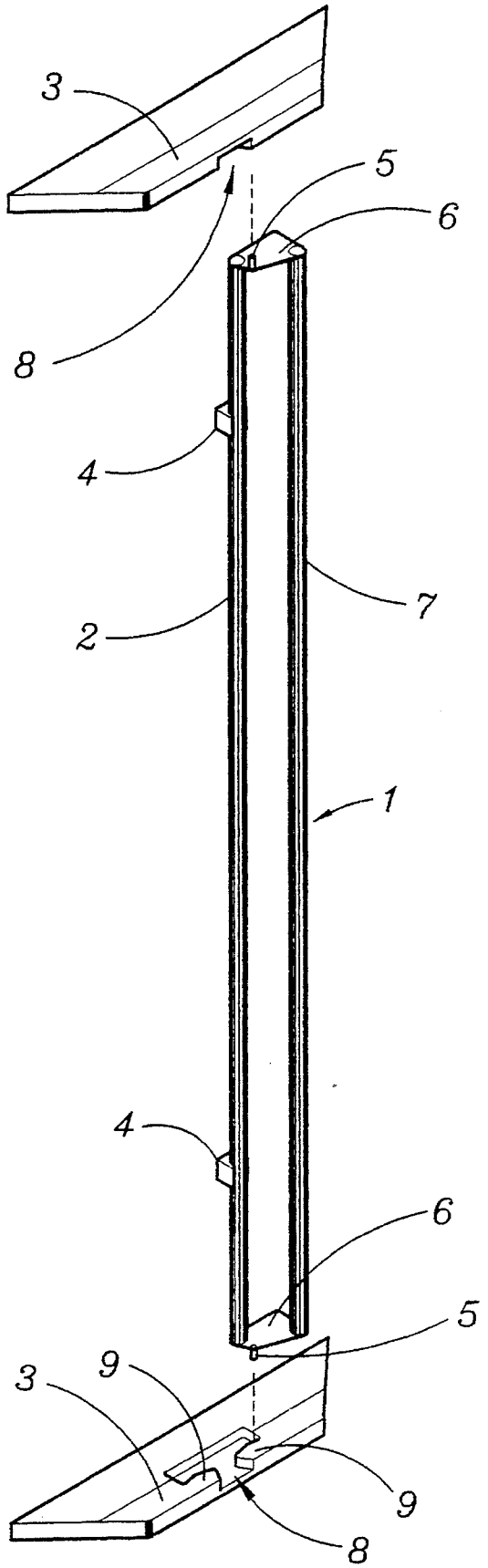
FIG. 1 is a side elevational orthogonal view of the door operating mechanism assembly of the invention.

Referring to FIG. 1, the door operating mechanism assembly 1 of the present invention is shown comprising a vertical pivot shaft 2, keeper members 3 affixed to the edges of a cabinet, and clamps 4 which are adapted to be affixed to the door on which the assembly 1 is mounted. The vertical pivot shaft 2 is rotatively mounted in the clamps 4, which clamps 4 are spaced apart from the ends of the vertical pivot shaft 2. Eccentric or offset pins 5 are affixed to end surfaces or lever members 6, which lever members are affixed to the ends of the vertical pivot shaft 2. A handle 7 is affixed at its ends to the distal ends of the lever members 6. The keeper members 3 each have a receiving aperture 8 for receiving the eccentric pins 5 and detents 9 for engaging the eccentric pins 5.

Figure 2:
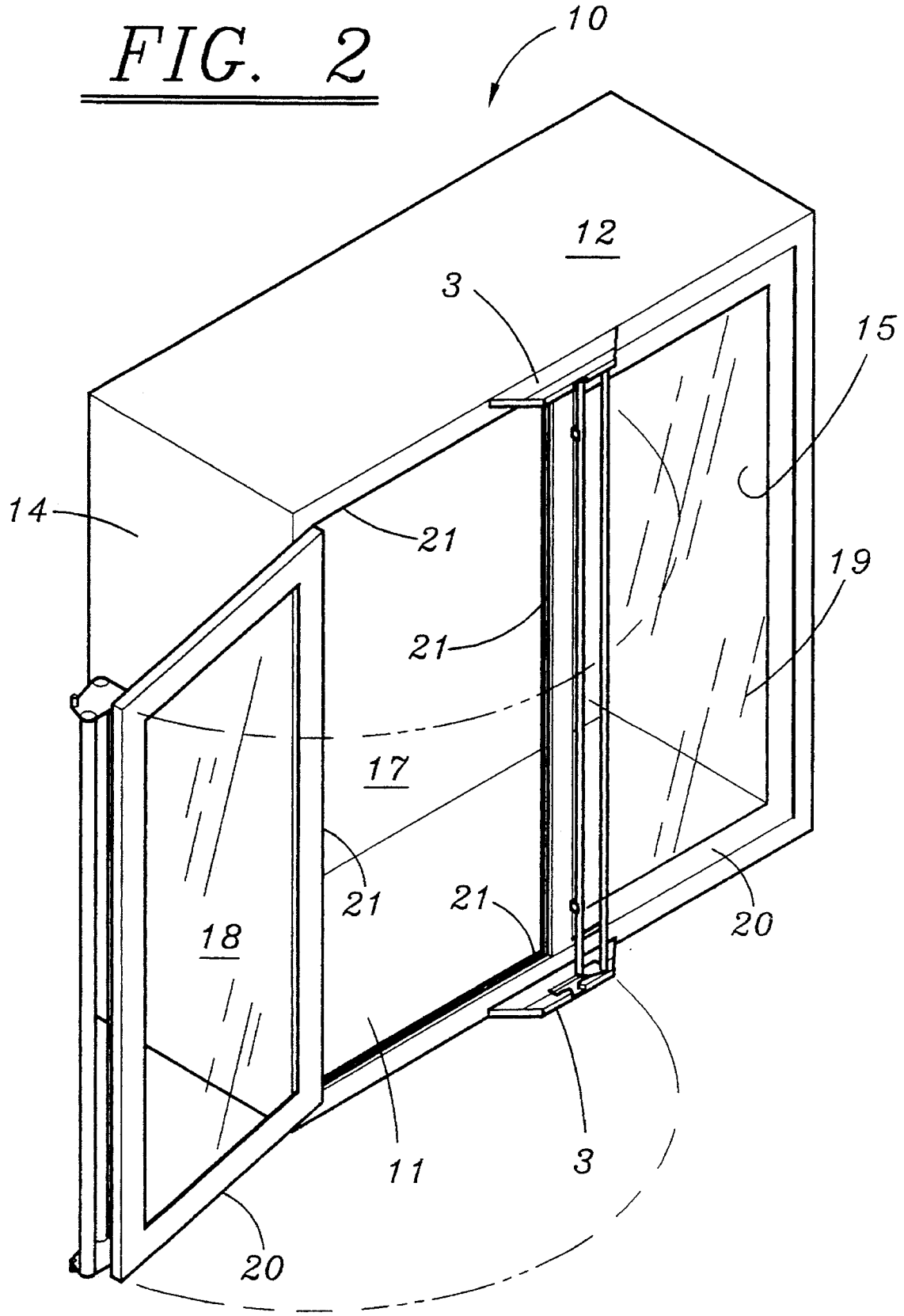
FIG. 2 is an orthogonal view of a cabinet having the door operating mechanism assembly of the invention mounted thereon.

Referring to FIG. 2, an enclosure or cabinet 10 is shown upon which the door operating mechanism assembly 1 of the invention is mounted. The cabinet comprises a bottom panel member 11, a top panel member 12, a left side panel member 14, a right side panel member 15, and a rear panel member 17. The panel members are mounted on a cabinet frame 16. Also shown are a left door panel 18 and a right door panel 19. A door frame 20 is also shown having a sealing gasket 21 of a flexible material mounted on the edges of the door frame.

Figure 3:
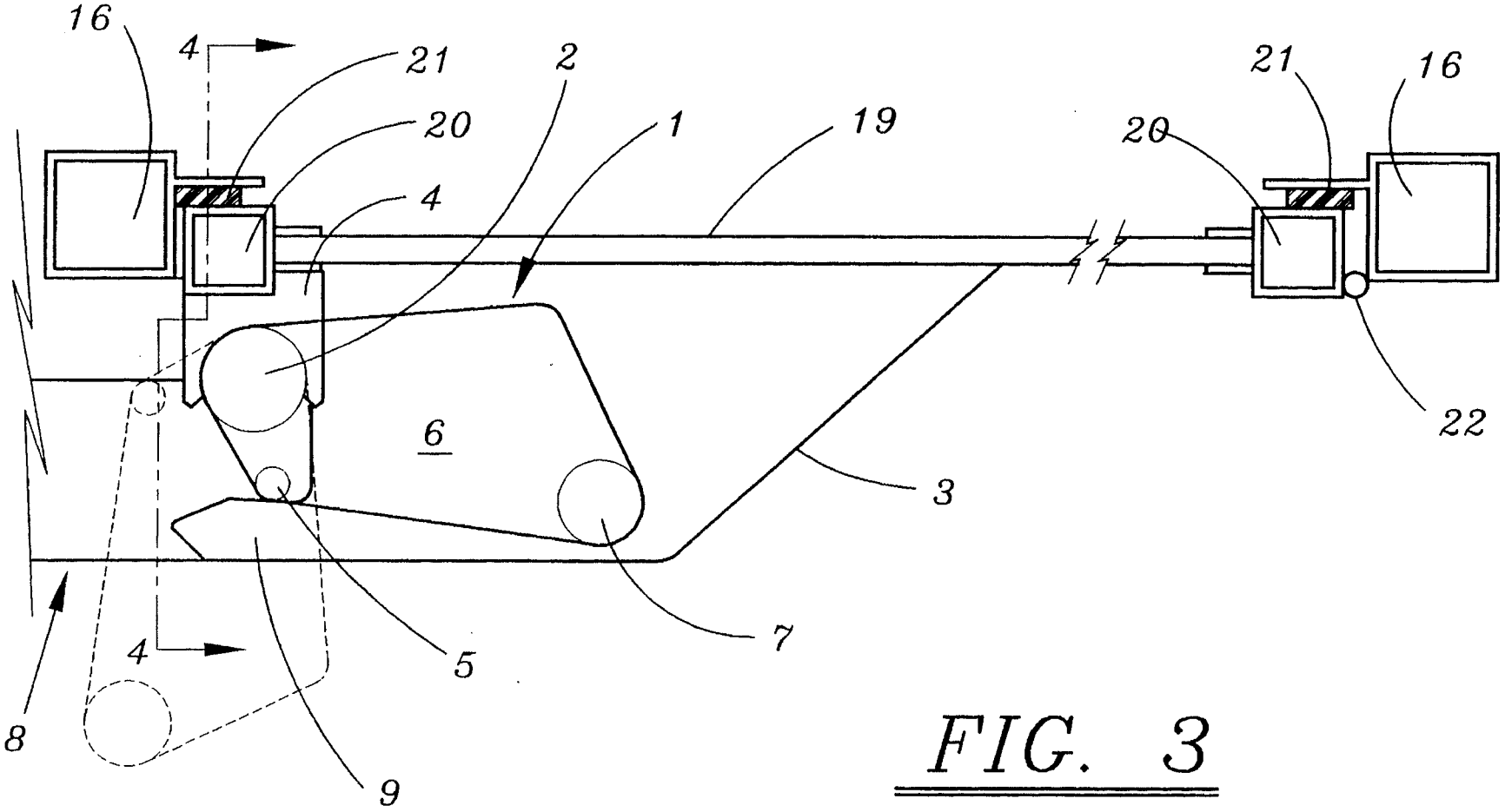
FIG. 3 is a fragmentary top view of a portion of a cabinet as shown in FIG. 2 showing the top of the right door, and having a door operating mechanism assembly mounted thereon.

Referring to FIG. 3, the top of the right door panel 19 is shown having its door frame 20 hingedly connected to the cabinet frame 16 by means of door hinges 22. As shown in phantom lines, the door operating mechanism assembly 1 is in the position in which the door is unlatched. To latch the door, the door is closed so that the eccentric pins 5 enter the receiving aperture 8 of the keeper members 3. The handle 7 is then grasped and the assembly 1 rotated counterclockwise until the eccentric pin is engaged by the detent 9.

According to the invention, the vertical pivot shaft is formed of an elastic, or more precisely, a flexible or resilient material. Additionally, according to the invention the clamps 4 are formed of a suitable length and the keeper members 3 have the detents 9 positioned in a certain relationship. Additionally, the clamps 4 must be spaced a distance from the ends of the vertical pivot shaft 2. The arrangement is such that when the eccentric pins 5 engage the detents 9, the ends of the vertical pivot shaft are pulled and displaced inwardly toward the keeper members 3, thereby causing the center of the vertical pivot shaft 2 to bow outwardly, and providing a positive compression force against the door causing the door to seal and compress the edges of the door against the sealing gasket 21 and maintaining the sealing gasket compressed, as illustrated in FIG. 4.

Figure 4:
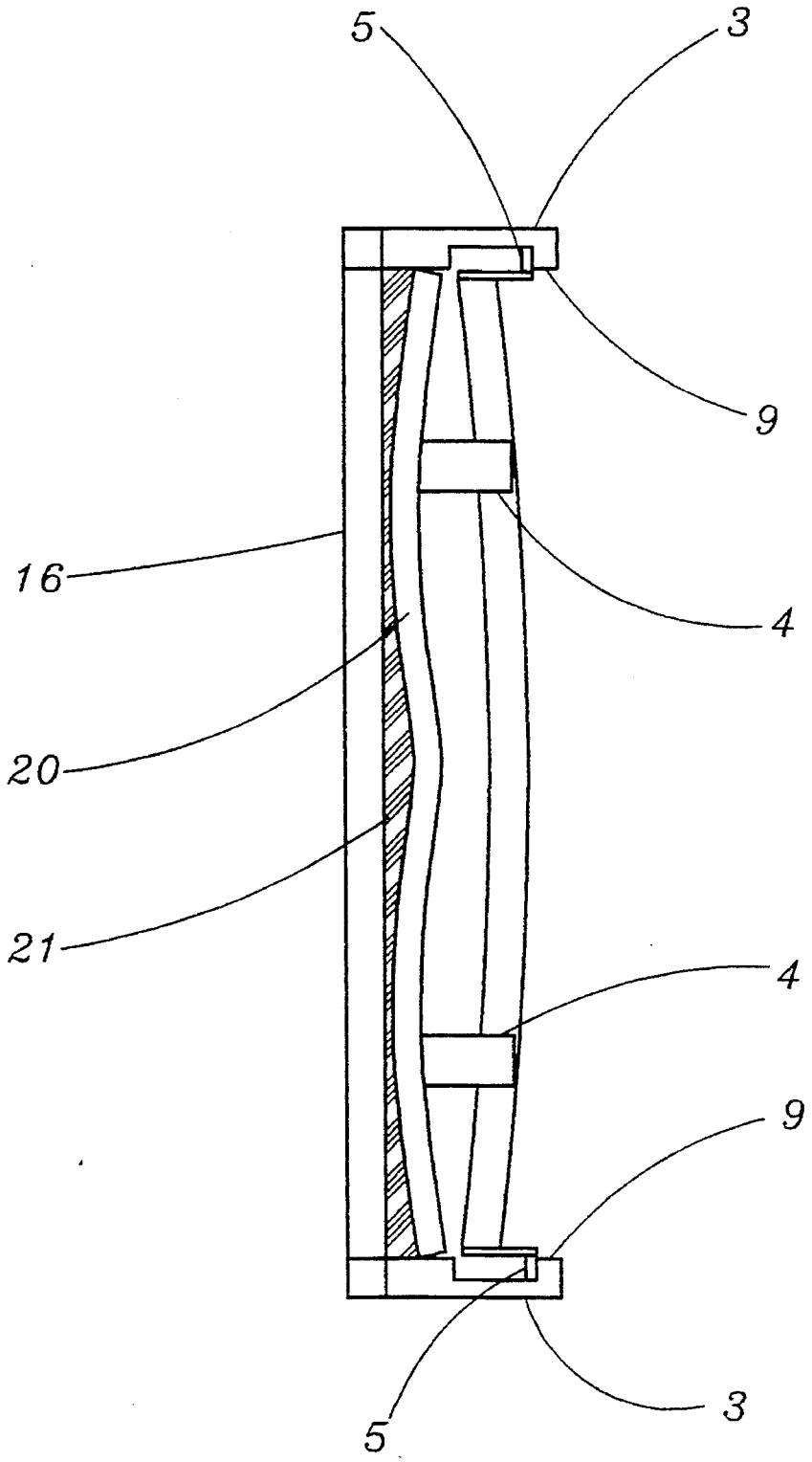
FIG. 4 is an end view partly in cross-section, taken at the line 4—4 of FIG. 3.

Referring to FIG. 4, an edge view of the cabinet with the door in compressed position against the detent is shown. The ends of the vertical pivot shaft 2 are pulled inwardly and displaced toward the door, thus causing the pivot shaft to bend and exert a force against the clamps 4 in which they are rotatively retained. As can be seen, the ends of the pivot shaft 2 are pulled toward the cabinet by the engagement of the eccentric pins 5 with the keeper members 3, thus applying a force to the clamps 4 and urging the door against the sealing gasket 21 mounted on the cabinet, compressing the sealing gasket 21 and providing a positive seal, thereby preventing any material such as a gas from leaking through the seal between the door 20 and the sealing gasket 21.

The objects of the invention are achieved by providing a door operating mechanism, and more particularly a door operating mechanism comprising a vertical elastic pivot shaft equipped with two eccentric pins, as follows:

A door operating mechanism, preferably a door operating mechanism for cabinets, comprising a vertical pivot shaft (2) equipped with eccentric pins (5) at opposite ends thereof to cooperate with keeper members (3) characterized by, that the vertical pivot shaft (2) is fixed by one or more clamps (4) secured to the door at certain spaced-apart distances from the bottom and the top of the cabinet doors and from the ends of the vertical pivot shaft thereby permitting the elastic force occuring in the vertical pivot shaft (2) to the employed to close the door tightly against the sealing gasket on the cabinet.

A door operating mechanism as above characterized by, that the door operating mechanism includes the following individual components: a vertical elastic pivot shaft including handle and eccentric pins (1); keeper members (3) at the top and at the bottom; as well as a number of clamps (4) secured to the cabinet door for fixing of the vertical shaft (2).

A door operating mechanism as above characterized by, that the shaft (2) is fixed by one or more clamps (4).

A door operating mechanism as above characterized by, that the keeper members (3) are designed to operate two vertical shafts (2) equipped with eccentric pins (5) simultaneously, and that the keeper member is symmetrical, and that the same keeper member is applied at both the bottom and the top of the cabinet.

A door operating mechanism as above characterized by, that the keeper member (3) is designed to operate as a fender protecting the cabinet and the handle during for example transportation.

Application of a door operating mechanism as above for cabinet doors for e.g. laboratory cabinets, experimental animal cabinets, refrigerator cars, containers, refrigerators, deep freezers, industrial washing machines, and industrial automatic dishwashers.

The invention has been developed with the main object of ensuring optimal tightening of the cabinet doors. This has been achieved by using the elastic effect occuring in the vertical shaft (2) when fixed in a number of clamps on the cabinet door.

The present invention is especially suitable for a ventilated cabinet with highly efficient filters mounted on the air in- and outlet. As such cabinets especially are used to house experimental animals in connection with various research projects, it is of the utmost importance that the cabinet doors are tight in closed position. This prevents non-filtered air from entering through leaks e.g. where the doors meet the cabinet. The consequence of non-filtered air entering the cabinet may result in unreliable, non-reproducible, and incomparable test results.

Furthermore the personnel by the invention is protected from possible allergens from the air in the cabinet.

The vertical shaft of the presently known door operating mechanisms in the prior art is rotatably retained only at the ultimate top and at the ultimate bottom of the cabinet. The natural consequence being that the door only closes tightly in those points and a slightly concave bending of the door arises which permits an undesirable flow of air to enter into the cabinet.

By fixing the shaft by a number of clamps mounted at a certain distance from the top and the bottom, the bending of the door against the sealing gasket on the cabinet frame is reduced to a minimum. Furthermore, this ensures that the pivot shaft of the door operating mechanism produces a uniform and constant pressure in closed position, thus obtaining optimal tightness between the edges of the door frame and the sealing gasket.

A constant and equally distributed force from the pressure of the sealing gasket is applied to the door frame (the working force to be applied to the sealing gasket in question according to the manufacturer). The equally distributed force occuring from the sealing gasket and one single force at each end of half the horizontal sealing force from the profile at the top and at the bottom, act on the vertical closing profile of the door frame.

Furthermore, a number of individual opposite forces corresponding to the number of clamps act on the closing profile.

The pivot shaft of the door operating mechanism exerts a pressure on the door frame through a number of clamps, with an opposite force corresponding to the pressure of the sealing gasket. This force occurs when the keeper members at each end make the pivot shaft bend at the clamps.

To fix the dimensions of the pivot shaft of the door operating mechanism and the keeper member, the number and the position of the clamps are calculated so that the bending of the closing profile of the door is reduced to a minimum.

When these factors are known, the necessary bending of the pivot shaft is calculated to obtain the optimal pressure against the sealing gasket in closed position.

The keeper members are so designed that said bending is maintained when the door is closed resulting in a constant elastic force being exerted on the door by the pivot shaft.

An example of such calculation using two clamps is as follows.

Definitions:

P1: Equally distributed force from the sealing gasket

P2: Single force from the horizontal profile at each end of the door

P3: The total necessary closing pressure

E: The modulus of elasticity of the profile/pivotshaft

I: The moment of inertia of the profile/pivot shaft l: The distance between the symmetrically fixed clamps c: The distance from the end of the profile to the clamp L: 1+2*c ume : Bending at the middle from the single force uee : Bending at the ends from the single force umj : Bending at the middle from the equally distributed force uej : Bending at the ends from the equally distributed umin: Minimum total bending of the the vertical profile uaf : Bending of cabinet profile uind: Bending of pivot shaft $$ume := -\left[ P2 \cdot l^2 \cdot \frac{c}{8 \cdot E \cdot I} \right] \square$$

$$uee := \left[ P2 \cdot \frac{c^2}{E \cdot I} \cdot \left[ \frac{c}{3} + \frac{1}{2} \right] \right] \square$$

$$umj := \left[ \frac{5 \cdot \frac{P1}{L} \cdot l^4}{384 \cdot E \cdot I} - \frac{\frac{P1}{L} \cdot c^2 \cdot l^2}{16 \cdot E \cdot I} \right] \square$$

$$x := \frac{L}{2} \square$$

-continued $$uej := \left[ \frac{P1}{\frac{l+2\cdot c}{16\cdot E\cdot I}} \cdot l^4 \cdot \left[1-4\cdot\frac{x^2}{l^2}\right]\cdot\left[\left[\frac{5}{24}-\frac{c^2}{l^2}\right]-\frac{1}{6}\cdot\frac{x^2}{l^2}\right]\right] \square$$

The distance c is optimized for minimum bending, "uaf" indicates a possible bending of the cabinet profile.

$$umin := ume + umj - (uee + uej) - uaf\ a$$

When c is known, the necessary bending of the pivot shaft is calculated.

$$uind := \left[\frac{P3}{2}\cdot\frac{c^2}{E\cdot I}\cdot\left[\frac{c}{3}+\frac{1}{2}\right]\right] \square$$

In one embodiment of the invention the pivot shaft may be fabricated at each end in the form of a crankshaft. The crank at each end then serves as the eccentric or offset pin 5. In a preferred form the pivot shaft forms part of an assembly (1) defined by two bars of which one is the vertical elastic or flexible pivot shaft (2) and the other is a handle (7). These bars are preferably fully welded to the top and bottom end surfaces or lever members (6). Eccentric pins are welded to the opposite sides of said end surfaces or lever members 6, for engagement with keeper members (3) secured to the top and bottom of the cabinet. The assembly follows the full height of the cabinet.

In another embodiment of the invention the keeper member is symmetrical thereby permitting an identical keeper member to be used at both the top and the bottom of the cabinet. This is preferable when using double hinged doors.

Furthermore, the keeper member is provided with a fender effect protecting the handles from bumps, etc. for example during transportation.

Said fender effect is provided by making the keeper member sufficiently large to constitute the outermost point of the cabinet at both the top and the bottom.

Consequently, a complete door operating mechanism comprising as few components as possible, thereby reducing the manufacturing costs for materials, molding tools, etc. to a minimum, has been achieved.

Furthermore, said door operating mechanism is very simple to handle in that the handle (7) is provided by a vertical bar which extends along the entire height of the cabinet.

Grasp the handle with one hand, then turn it approximately 80 degrees and pull it outwardly.

Furthermore, this simple construction makes the door operating mechanism easy to clean in that all dirt traps are eliminated.

I claim:

1. An enclosure comprising a plurality of wall members having free edges, including a top wall member, a bottom wall member, a rear wall member, and a pair of side wall members, a sealing gasket mounted on the free edges of each of said top, bottom, and side wall members, a door hingedly mounted at one edge thereof to an edge of one of said side wall members, a door operating mechanism assembly comprising:

a vertical pivot shaft having a longitudinal axis, a central portion and two ends, two clamps affixed to said door at a free vertical edge thereof, characterized in that one of said clamps is spaced apart from an upper horizontal edge of said door, and the other of said clamps is spaced apart from a lower horizontal edge of said door, said vertical pivot shaft being rotatably retained in said clamps, said clamps being in spaced relationship from the ends of said vertical pivot shaft, an eccentric pin mounted at each end of said shaft in fixed relationship thereto and having a first distance measured from the longitudinal axis of said vertical pivot shaft, lever arm means affixed at one end thereof to an end of said shaft, handle means affixed to the other end of said lever arm means, a pair of keeper members mounted one at the edge of said top wall member and the other at the edge of said bottom wall member, each keeper member having an aperture to receive said eccentric pin and a detent provided therein to retain said eccentric pin said detent having a second distance measured from the longitudinal axis of the vertical pivot shaft, as maintained by said clamps, characterized in that the first distance is larger than the second distance, so that, when said door is closed, said eccentric pins engage the detent of said keeper members, the ends of said vertical pivot shaft are forced inwardly and the central portion of said vertical pivot shaft is bowed outwardly, thereby providing a force clamping said door against the sealing gasket of said enclosure, whereby said door may be closed and securely engaged against said sealing gasket by grasping said handle means and rotating said vertical pivot shaft until said eccentric pins enter said keeper members and engage the detents thereof.

2. An enclosure according to claim 1, wherein each end of said vertical pivot shaft is in the form of a crank, thereby defining said eccentric pins.

3. An enclosure according to claim 1, wherein said door operating mechanism has a pair of lever arm means, one affixed at one end thereof to one end of said vertical pivot shaft, and the other affixed at one end to the other end of said vertical pivot shaft, an eccentric pin affixed to each of said lever arm means, and said handle extending the entire length of said vertical pivot shaft, said handle being affixed at one end to the other end of one of said lever arm means and affixed at the other end to the other end of said other lever arm means.

4. An enclosure according to claim 3, wherein said enclosure has two doors, and wherein said keeper members each have a pair of detents adapted to engage the eccentric pins from both said doors.

* * * * *

UNITED STATES PATENT AND TRADEMARK OFFICE

CERTIFICATE OF CORRECTION

PATENT NO. : 5,487,574
DATED : Jan. 30, 1996
INVENTOR(S) : Bo Salling

It is certified that error appears in the above-indentified patent and that said Letters Patent is hereby corrected as shown below:

TITLE PAGE, [57], ABSTRACT, line 5: "retained clamps" should read -- retained by clamps --.

Column 1, line 14: "relational" should read -- relationship --.

Columnn 3, line 13: "shaft (2) to the" should read -- shaft (2) to be --.

Signed and Sealed this

Fourth Day of June, 1996

Bruce Lehman

*Attest:*

BRUCE LEHMAN

*Attesting Officer*

*Commissioner of Patents and Trademarks*